United States Patent [19]

Ingvarsson

[11] Patent Number: 4,899,568

[45] Date of Patent: Feb. 13, 1990

[54] ROLLING MILL MACHINE FOR LONGITUDINAL BENDING OF PLATE

[75] Inventor: Lars I. Ingvarsson, Borlänge, Sweden

[73] Assignee: Ortic AB, Borlänge, Sweden

[21] Appl. No.: 255,688

[22] Filed: Oct. 7, 1988

[30] Foreign Application Priority Data

Oct. 9, 1987 [SE] Sweden ..... 8703923

[51] Int. Cl.[4] ..... B21D 5/08; B21D 13/04

[52] U.S. Cl. ..... 72/181; 72/176

[58] Field of Search ..... 72/176, 179–182, 72/164, 226, 234, 238

[56] References Cited

U.S. PATENT DOCUMENTS

| | | | |
|---|---|---|---|
| 468,655 | 2/1892 | Griffin | 72/182 |
| 971,277 | 9/1910 | Johnson | 72/181 |
| 1,056,871 | 3/1913 | White | 72/176 |
| 3,251,211 | 5/1966 | Harris | 72/181 |

FOREIGN PATENT DOCUMENTS

| | | | |
|---|---|---|---|
| 8704375 | 7/1987 | European Pat. Off. . | |
| 23709 | 8/1883 | Fed. Rep. of Germany | 72/180 |
| 2816993 | 10/1979 | Fed. Rep. of Germany | 72/226 |

*Primary Examiner*—Daniel C. Crane
*Attorney, Agent, or Firm*—Nils H. Ljungman

[57] ABSTRACT

A rolling mill machine is for longitudinal bending of plate to provide a cross-sectional profile. The machine includes elements for advancing the plate in a longitudinal direction through a plurality of longitudinally spaced shaping stations. Each of the shaping stations extends in a generally transverse direction relative to the longitudinal direction and includes an upper row of forming rolls and a lower row of forming rolls which are disposed in spaced relationship along the transverse direction for respectively bending the plate advancing therebetween to form the profile. Some of the shaping stations include centrally located forming rolls being longitudinally displaced forwardly of the other of forming rolls in the upper and lower rows for initially bending the plate by these centrally located forming rolls. Additonally, the forming rolls respectively combine with corresponding other forming rolls to form generally converging longitudinal rows of the forming rolls. The machine may include each of the forming rolls being mounted for rotation about a shaft which extends perpendicular to the longitudinal rows of each of the forming rolls.

20 Claims, 3 Drawing Sheets

ROLLING MILL MACHINE FOR LONGITUDINAL BENDING OF PLATE

BACKGROUND OF THE INVENTION

1. Field of the Invention:

The invention relates to a rolling mill machine for longitudinal profile bending of thin plate and, more specifically, to such a machine for manufacturing of building plate with a generally trapezoidal cross section. The basic machine includes a number of shaping stations with individual forming or work rolls above and below the plate which are arranged in such a pattern that they form rows both across the direction of the movement of the plate and along the direction of the movement of the plate.

2. Description of the Prior Art:

German Laid Open Patent Appln. No. 29 41 180 and PCT International Published Appln. No. WO 87/04375 disclose machines which longitudinally bend plate and are incorporated by reference as if they are included in their entirety herein. Generally the prior art machines include an array of forming rolls above and below the plate or strip which are arranged in straight rows across the direction of the movement of the plate or strip through the machine. Although such machines should function satisfactorily if constructed with a sufficient number of shaping stations and with a great distance between the shaping stations, there remains a need for any such machine which could employ less forming rolls and would properly function in less space in a metal forming plant.

OBJECTS OF THE INVENTION

It is an object of the invention to provide a rolling mill machine which is capable of effectively and efficiently forming plate with a generally trapezoidal cross section or profile.

It is another object to provide such a machine which is easy to provide and requires less space in the metal forming plant.

It is still another object to provide such a machine which is configured to decrease the resistance to the longitudinal bending of the plate to allow a more economical formation of the cross section thereof.

SUMMARY OF THE INVENTION

These and other objects of the invention are provided in a preferred embodiment thereof including a rolling mill machine for longitudinal bending of plate to provide a cross-sectional profile. The machine includes elements for advancing the plate in a longitudinal direction therethrough. A plurality of shaping stations is disposed in spaced relationship along the longitudinal direction. Each of the shaping stations extends in a generally transverse direction relative to the longitudinal direction. Each of the shaping stations includes an upper row of a plurality of forming rolls and a lower row of a plurality of forming rolls which are disposed in spaced relationship along the transverse direction for respectively bending the plate advancing therebetween to form the profile. At least some of the shaping stations include the forming rolls located centrally in the upper and lower rows being longitudinally displaced forwardly of the other forming rolls in the upper and lower rows for initially bending the plate by the forming rolls which are centrally located as the plate is advanced through each of the shaping stations.

Another embodiment of the invention includes a rolling mill machine for longitudinal bending of plate to provide a cross-sectional profile. There is included elements in the machine for advancing the plate in a longitudinal direction therethrough. A plurality of shaping stations is disposed in spaced relationship along the longitudinal direction. Each of the shaping stations extends in a generally transverse direction relative to the longitudinal direction. Each of the shaping stations includes an upper row of a plurality of forming rolls and a lower row of a plurality of forming rolls which are disposed in spaced relationship along the transverse direction for respectively bending the plate advancing therebetween to form the profile. Each of the forming rolls of the upper rows and each of the forming rolls of the lower rows respectively combine with corresponding other forming rolls of the upper rows and with corresponding other forming rolls of the lower rows to form generally converging longitudinal rows of the forming rolls. Each of the forming rolls is mounted for rotation about a shaft which extends perpendicular to the longitudinal rows of each of the forming rolls.

According to the present invention in at least one or more of the shaping stations, the forming or work rolls are arranged so that the middle roll or rolls in a transverse row begins to form the strip before the outer or end rolls. It appears to be particularly desirable for a number of the first shaping stations to have their rolls arranged in this manner.

Because of the invention, it is possible to both reduce the total length of the machine and the number of shaping stations and to make the machine more compact. In addition, the final product produced in a machine according to this invention will be of higher quality with regard to its shape and the machine can be used to shape cut strip.

By angling of the forming or work rolls and through the use of a calibration station in the manner as described hereinbelow, an improved shape accuracy in the final product is obtained.

Finally, if a support table is used as discussed hereinbelow, the total length of the machine and the number of shaping stations can be further reduced.

DESCRIPTION OF THE PREFERRED EMBODIMENT

Figure 1:
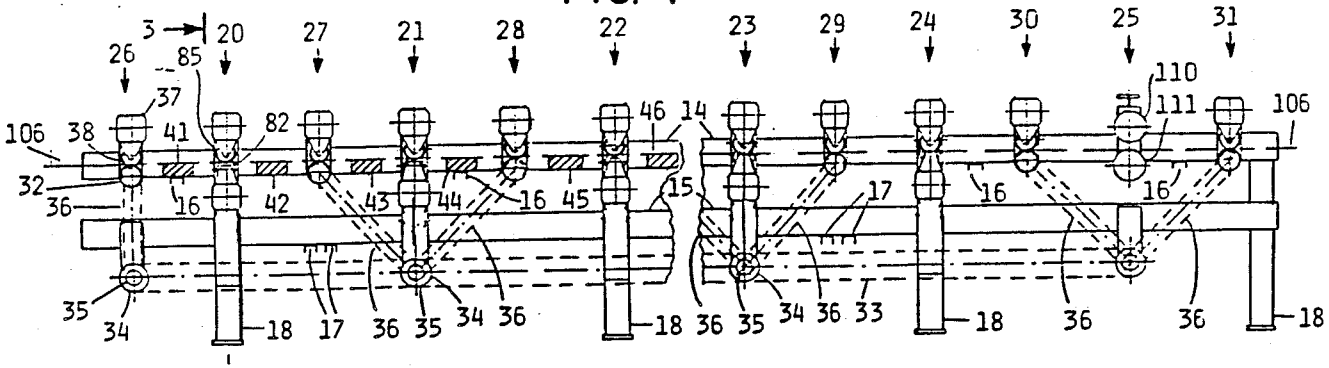
FIG. 1 is a fragmentary, side elevation of a preferred rolling mill machine according to the invention as generally seen along line 1—1 of FIG. 2.
Figure 2:
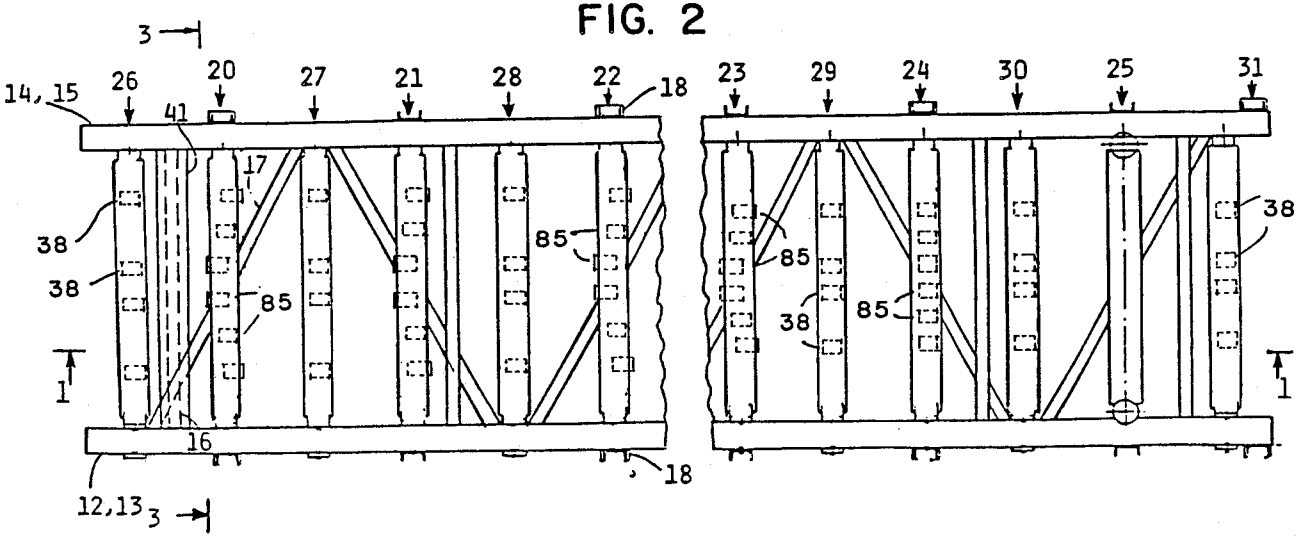
FIG. 2 is a plan top view of the machine shown in FIG. 1.

The preferred rolling mill machine as seen in FIGS. 1 through 4 includes a housing, the chief parts of which are made up of an upper longitudinal beam 12 and a lower longitudinal beam 13 on the one side of the machine and a corresponding upper longitudinal beam 14 and lower longitudinal beam 15 on the other side. A number of posts 18 support and hold together on the respective sides of the machine the upper and lower beams 12 and 13, 14 and 15. The upper beams 12, 14 are held together with a number of cross-tie beams 16 while the lower beams 13, 15 are held together with a number of cross-tie beams 17 as shown in FIGS. 1 and 2.

Within the housing of the preferred machine, a number of shaping stations have been provided with only the first three stations 20–22 and the last two stations 23, 24 being shown. The midsection of the machine, which has, for example, about five shaping stations, has been cut away in FIGS. 1 and 2. A calibration station 25 with cylindrical full-width rolls 110, 111 is installed to follow the final shaping station. A plurality of drive stations 26–31 are located between the shaping stations and serve as the first and last station of the preferred machine.

The drive stations 26–31 are all principally alike and an explanation with reference to the first drive station 26 as seen in FIGS. 1 and 2 will be applicable to the other drive stations 27–31. Each of the drive stations 26–31 includes a lower cylindrical drive roll 32, which is provided with a rubber coating to increase the friction. The drive rolls 32 are driven in tandem by a motor (not shown) through a drive chain 33 which rotates a number of sprocket wheels 34. The sprocket wheels 34 share a shaft with smaller sprocket wheels 35, which respectively rotate the drive sprocket wheels of the drive rolls 32 through short chains 36. The chains 33, 36, which are shown in a FIG. 1 with broken lines, are located next to the beams 14, 15. However, in order to simplify FIG. 2, the drive chains and the sprocket wheels have been left out of FIG. 2. The drive stations all have an upper box beam 37 in which there is a row with free-rolling counter rolls 38 which are aligned with and run against the drive rolls 32.

Support tables 41–46 are respectively located between the first six alternating drive and shaping stations. The support tables 41–46 are secured to and extend between the upper longitudinal beams 12, 14.

The shaping stations 20–24 are similar to each other except for the particular placement of the freely rotating rolls thereon which vary as described hereinbelow with reference to FIG. 4.

Figure 3:
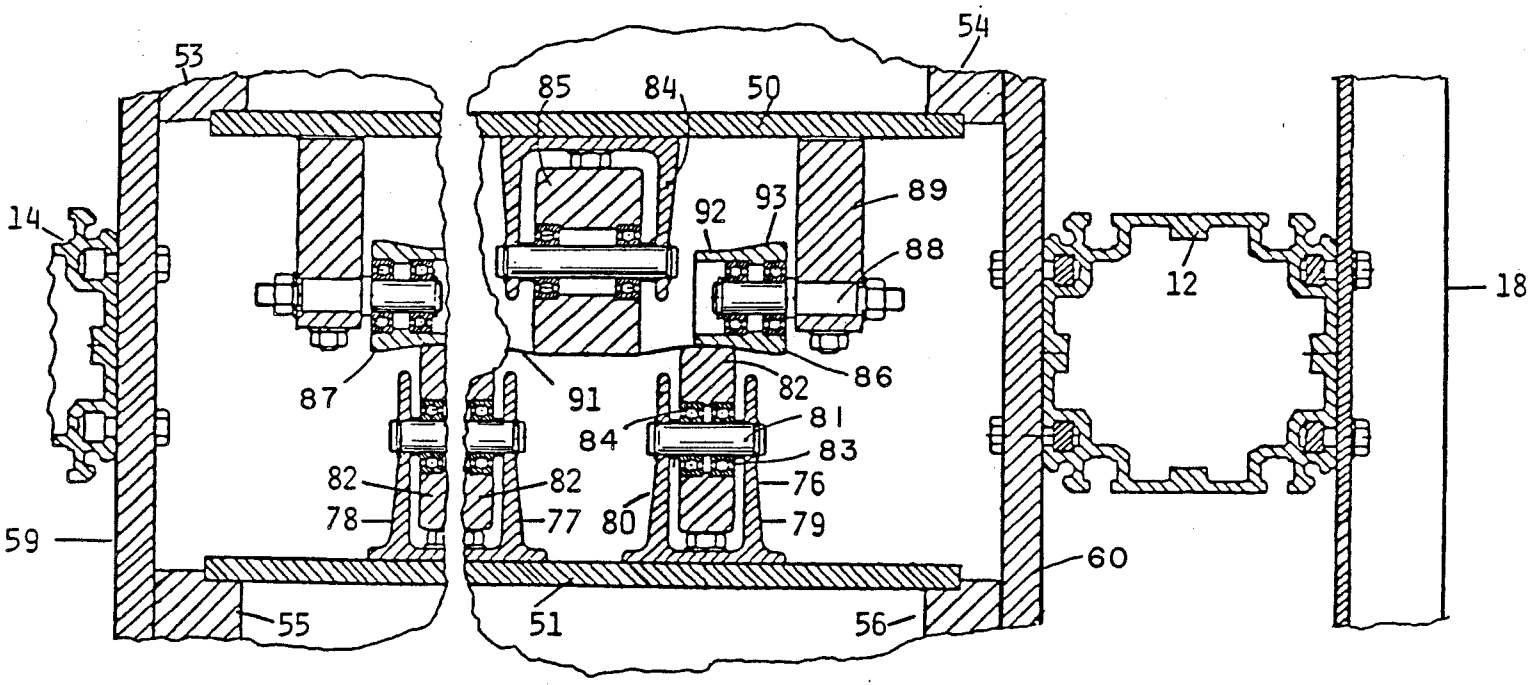
FIG. 3 is a fragmentary sectional view as seen along the line 3—3 of FIGS. 1 and 2.

The shaping station 20 shown in detail in FIG. 3 include various parts which are included in all of the other shaping stations 21–24. Each of the shaping stations includes an upper horizontal, transverse box beam 50 and a lower horizontal, transverse box beam 51 which respectively have square cross-sections.

Each of the box beams 50, 51, have flanges or end plates 53, 54 and 55, 56 with which they are secured to vertical strips or keeper plates 59, 60, which are respectively secured to the beams 14, 15 and 12, 13, of the housing.

On the lower beam 51 seven brackets are mounted with screws although only one bracket 76 is completely shown while the fragmentary halves of two brackets 77, 78 are included. The remaining brackets are omitted with the corresponding intermediate region of the beam 51 which is omitted from FIG. 3. Each of the brackets have two wings 79, 80, as is indicated on bracket 76, and a shaft 81 extends through holes in the wings 79, 80. A roll 82 is mounted on the shaft 81 with axially spaced, double bearings 83, 84 so that it is free-rolling but remains axially aligned on the shaft 81.

On the upper beam 50, there is a row with six brackets 84 with rolls 85 attached thereto. The number of brackets in the row is one less than those provided for beam 51 in order to be properly disposed therebetween. Again, only one bracket and one roll are seen in FIG. 3. The rolls 85 are aligned laterally between the rolls 82. As a result, the plate or strip 91, which is to be formed by the so-called free-forming, is formed without its being squeezed between two opposite rolls as with conventional shaping.

At both outer sides of the beam 50 there are two edge rolls 86, 87 similarly mounted with axially spaced, double bearings on fixed shafts 88 secured in brackets 89. A cylindrical part 92 of each edge roll 86, 87 is directly aligned with the corresponding exterior of rolls 82 at the outer ends of the beam 51 with the plate or strip 91 being guided therebetween. The outer edges of the strip 91 are formed by the outer cut-off conical sections 93 of the edge rolls 86, 87.

As seen in FIG. 1, all the rolls of the upper beam of the shaping stations 20–24 (rolls 85 and beam 50 of FIG. 3) which are in an operative position touch a horizontal plane 106, designated by broken lines. The plane 106 also touches all the drive rolls 32 and their counter rolls 38 of the drive stations 26–31.

The plane 106 defines an entry plane for the flat plate or strip and a delivery plane for the finished, profiled strip. In other words, the plane 106 is the plane at which the lower region of profile flanges lie with the remainder of the profile extending thereabove. An entry table and delivery table in the plane 106 can be made separate from the machine and are not shown on the figures. The support tables 41–46 also lie in the plane 106.

The lower drive rolls 32 and the counter rolls 38 of the drive stations 26–31 thus clamp on the lower region of the profile flanges of the strips 91 therebetween. The bearing or clamping pressure is adjustable with springs (not shown) in a manner which is well known in the metal-forming art. As generally shown in FIG. 2, the counter rolls are not needed in every lower flange. There can be, by way of example, only four counter rolls even though six work rolls are employed to create six lower flanges.

Figure 4:
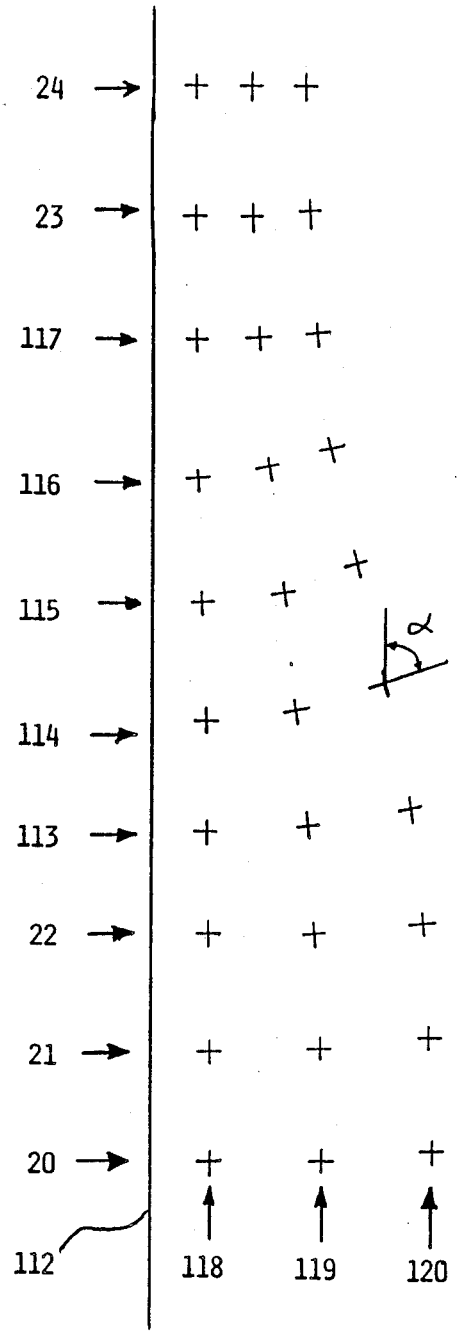
FIG. 4 is an example of a plan for placement of the forming or work rolls of the preferred machine of FIGS. 1-3.

As shown in FIG. 4, the location and position of each of the work rolls 85 are indicated by a small cross. Each cross represents in part the plane of symmetry of the roll transverse to its rotational shaft and in part the rotating shaft of the work roll. As is evident from FIG. 4, the work rolls in each shaping station are placed in rows which extend in a generally transverse direction relative to the longitudinal direction of the plate 91 moving through the machine. FIG. 4 is directed to only one half of the preferred machine and includes the small crosses to represent only the rolls 85 of the upper beam 50. The edge rolls 86, 87 of the upper beam 50 and the rolls 82 of the lower beam 51 are not shown to simplify FIG. 4. It should be understood that the discussion provided hereinbelow for the rolls 85 will be equally applicable for the rolls 86, 87, 82 although, as will be explained hereinbelow, these rolls would be in entirely different but generally "parallel" longitudinal rows. It should also be noted that only the final shaping station 24 has the work rolls thereof disposed in a straight line.

The remainder of the shaping stations have their rolls placed in an arc of the generally transversely extending rows. Further, as suggested above, each of the work rolls 85 of the upper beam 51 combine with correspondingly disposed work rolls 85 of the other upper beams 51 to form one of a plurality of generally converging longitudinal rows 118, 119 and 120. Each row 118, 119, 120 shapes a lower flange and the strip is formed by means of these longitudinal rows of work rolls 85 to include six lower flanges. Generally, FIG. 4 is a simplified example of a plan for placing just the work rolls 85 in a machine of the type shown in FIGS. 1–3. As a result, FIG. 4 does not include an array of crosses for the similar but differently located longitudinal rows of rolls 82, 86, 87 although such longitudinal rows of these rolls would also be included in the machine.

The center line or plane 112 of the machine represents the vertical plane of symmetry and the placement of the rolls is shown only on one side of plane 112 since the rolls are disposed symmetrically. FIG. 4 includes a plan elevation of the placement of the rolls 85 of FIG. 3 for each of the different shaping stations. In addition to the two sets of shaping stations 20–22 and 23, 24 shown in FIGS. 1 and 2, five shaping stations 113–117, which lie therebetween are shown in FIG. 4 to include a total of ten shaping stations.

Preferably, the rolls of the first shaping station 20 are parallel to the vertical plane of symmetry 112. In other words, the shafts these rolls should be at right angles or perpendicular to the plane of symmetry 112. It should be noted that the direction of feed of the plate or strip is upward in FIG. 4. In the longitudinal rows of work rolls 85 located in the shaping stations 21, 22, 113, 114, the rotating shafts are in successively decreasing angles relative to the plane 112. This angle is illustrated as angle $\alpha$ for the outer roll 85 of the shaping station 114. On the other hand, if the converging of the longitudinal rows is analyzed with reference to the longitudinal direction through the machines, the generally longitudinal rows could be at an angle of $90°\alpha$ to the longitudinal direction and would be successively increasing for the shaping stations 21, 22, 113, 114. In either case, the angle $\alpha$ is preferably held constant between the shaping stations 114 and 115 with the angle thereafter successively increasing and becoming almost a right angle in the final shaping station 24. It should be pointed out that the representation of FIG. 4 is not to scale and that the arc and angles have been exaggerated. Further, it would not be unusual for the number of shaping stations in which the rotating shafts of the work rolls in the respective longitudinal rows of work rolls are parallel to be more than the two rows 114, 115 which are shown. Additionally, in these shaping stations the rolls 85 tend to lie along straight lines in their respective portions of the longitudinal rows. On the other hand, three or four shaping stations are optimally needed in the bends in the beginning and end of the machine.

A practical example is directed to a similar machine which is different from the preferred machine of FIGS. 1 through 4. If such a machine includes a plate or strip with eleven upper flanges, an entry width of 1250 mm, a finished width of 1000 mm, and a section height of 20 mm, the angle $\alpha$ near the middle of the machine may be as small as 89.2°. In the same machine within the same shaping station 114 or 115, a roll 85 in an inner row 118 would be disposed as much as 9.5 mm in front of the corresponding roll 85 in an outermost longitudinal row 120.

Generally, in this array of longitudinal rows of the machine, the work rolls should be disposed so that their center lines lies along the line which runs through the center of the nearest previous roll. Further, the arc in every shaping station should be such that the rotating shaft of a roll is generally aligned to extend through or behind the center of the nearest inside roll relative to the direction of the movement of the strip. Normally, the middle roll or rolls in a shaping station which has the greatest arc would tend to lie 0.5 to 3 cm in front of the outermost rolls of the same shaping station.

Alternatively, in order to achieve a simpler assembly, it would be possible to place the rolls in wedge-shaped rather than arc-shaped transverse rows. Even in such a case, the shape of the generally transverse row would be non-linear and the middle rolls would begin to form the plate or strip before the outer rolls on the same shaping station.

A satisfactory result may be obtained if there are only a few axial positions and a few angled positions. Three or four axial positions and three or four angle positions could be chosen to generally agree with a preferred desired position. The use of only a few forms could simplify the mounting of the rolls. The significant point is that the middle roll or rolls should begin to shape the plate or strip first.

It is also possible for the wedge or arc form to be only employed on a number of the first shaping stations, such as, for example, the first three, four or five, in order to obtain a satisfactory result. When the plate or strip is formed to include a section height of over 0.5 or 1 cm, the exact position and angle of the rolls 85 are no longer as critical.

If the counter roll 38 used in the drive station is several millimeters narrower than the rolls 85, the assembly of the work rolls 85 is simplified because the placement of the counter rolls 38 is not as critical. It is also advantageous for the counter rolls 38 to be turned individually in the same manner as the work rolls. The counter rolls could be turned to urge the plate or strip sideways if it is found that the strip tends to deviate from a desired correct path because of minor alignment errors in the angle of the work rolls. As a result, all work rolls can be mounted before delivery of the machine and, following set-up of the machine, a final adjustment of several of the counter rolls 38 of the drive stations can be performed.

The conventional manner of completing the strip is to cut the strip into desired lengths after shaping in order to eliminate wedge-shaped strips which usually result from this type of progressive formation. The preferred rolling mill machine allows the plate or strip to be cut into the desired length before shaping without producing this undesired wedge shape.

In summing up, one aspect of the invention resides broadly in a rolling mill machine for the longitudinal profile bending of thin plate, e.g. for manufacture of building plate of trapezoidal section, comprising a number of shaping stations 20, 21, 22, 113, 114, 115, 116, 117, 23, 24 with individual free-rolling work rolls arranged in such a pattern that they form rows both across the direction of the movement of the strip and along the direction of the movement of the strip characterized by the fact that at least some of the shaping stations 20, 21, 22, 113, 114, 115, 116, 117, 23 have their work rolls 82, 85 so arranged that the middle roll or rolls in a row begin to shape the strip before the outer rolls.

Another aspect of the invention resides broadly in a machine characterized by the fact that the last shaping station 24 has its rolls arranged in straight transverse rows.

Yet another aspect of the invention resides broadly in a machine characterized by the fact that all of the shaping stations 20, 21, 22, 113, 114, 115, 116, 117, 23 except for the last have their rows arranged in arc or wedge shaped transverse rows.

A further aspect of the invention resides broadly in a machine characterized by the fact that in the longitudinal rows 118, 119, 120 of work rolls the first roll has its rotating shaft at right angles to the direction of feed of the strip and a number of the nearest following work rolls have their rotating shafts at a successively decreasing angle to the direction of feed of the strip.

A yet further aspect of the invention resides broadly in a machine characterized by the fact that in the longitudinal rows of the work rolls a number of the final work rolls have their rotating shafts at a successively increasing angle to the feed direction of the strip.

Yet another further aspect of the invention resides broadly in a machine characterized by the fact that a number of work rolls in each longitudinal row of work rolls have their rotating shafts in the same angle to the direction of feed of the strip and that these rolls are disposed along a straight line whereby the straight lines of the different rows converge.

An additional aspect of the invention resides broadly in a machine characterized by the fact that at least a number, preferably at least three, of the first shaping stations 20–22 have their work rolls arranged so that the middle roll or rolls in a row begin to form the strip before the outer ones.

A yet additional aspect of the invention resides broadly in a machine characterized by drive stations 26–31 between the shaping stations.

A further additional aspect of the invention resides broadly in a machine characterized by the fact that the drive stations 26–31 comprise a drive roll 32 and a plurality of free-rolling counter rolls 38 with individually adjustable direction.

A yet further additional aspect of the invention resides broadly in a machine characterized by support tables 41–46 between a number of the first stations (stations for shaping and for driving).

The invention as described hereinabove in the context of a preferred embodiment is not to be taken as limited to all of the provided details thereof, since modifications and variations thereof may be made without departing from the spirit and scope of the invention.

What is claimed is:

1. A rolling mill machine for bending of plate along the longitudinal axis of the plate as the plate is moved along a path which is generally parallel to the longitudinal axis of the plate through the rolling mill machine to provide a cross-sectional profile comprising:

means for advancing said plate along said path through said machine;

a plurality of shaping stations disposed in spaced relationship along said path;

each of said shaping stations each having forming rolls positioned adjacent to said path of said plate;

each of said shaping stations including an upper row of a plurality of forming rolls and a lower row of a plurality of forming rolls disposed in spaced relationship with said upper row and said lower row defining a direction which is transverse to said path of said plate for respectively bending said plate advancing therebetween to form said profile; and at least some of said shaping stations having at least some of said forming rolls being positioned out of said rows from the rows defined by the other of said forming rolls in said upper and said lower rows for initially bending said plate as said plate is advanced through each of said some of said shaping stations.

2. The rolling mill machine according to claim 1, wherein said upper row and said lower row of said some of said shaping stations have a non-linear shape with a central portion of each one of said rows being longitudinally in forward of each end portion of said each of said rows.

3. The rolling mill machine according to claim 2, wherein said non-linear shape is an arc.

4. The rolling mill machine according to claim 2, wherein said upper row and said lower row of a last of said shaping stations includes said forming rolls in straight transverse rows.

5. The rolling mill machine according to claim 2, wherein each of said forming rolls of said upper rows and said lower rows respectively combine with correspondingly disposed said forming rolls of the other of said upper rows and said lower rows to form one of a plurality of generally converging longitudinal rows of said forming rolls.

6. The rolling mill machine according to claim 5, wherein said machine has an entrance region, middle region and exit region with respect to said longitudinal direction therethrough, each of said longitudinal rows of said forming rolls converges generally toward a center of said machine, said longitudinal rows converge at an increased rate of converging between said entrance region and said middle region, and said longitudinal rows converge at a decreased rate of converging between said middle region and said exit region.

7. The rolling mill machine according to claim 6, wherein said each of said forming rolls in said longitudinal row is mounted for rotation about a shaft and said shaft of said each of said forming rolls in said longitudinal row extends perpendicular to said longitudinal row at said each of said forming rolls.

8. The rolling mill machine according to claim 6, wherein at least a part of some of said longitudinal rows of said forming rolls are in a straight line and said shafts of said forming rows in said part of said some of said longitudinal rows is perpendicular to said straight line.

9. The rolling mill machine according to claim 8, wherein said straight line of said part of said some of said longitudinal rows converge toward a said center of said machine.

10. The rolling mill machine according to claim 5, wherein said each of said forming rolls in said longitudinal row is mounted for rotation about a shaft and said shaft of said each of said forming rolls in said longitudinal row extends perpendicular to a direction of said longitudinal row at said each of said forming rolls.

11. The rolling mill machine according to claim 10, wherein said means for advancing said plate includes a plurality of drive stations extending in said a transverse direction and each drive stations is respectively disposed adjacent a different one of said shaping stations.

12. The rolling mill machine according to claim 11, wherein said drive station includes a drive roll on one side of said plate and a plurality of free-rolling counter rolls on the other side of said plate for advancing said plate therebetween, each of said counter rolls are disposed within one of said longitudinal rows, and at least some of said free-rolling counter rolls being adjustable for alignment with said longitudinal row.

13. The rolling mill machine according to claim 12, wherein said drive rolls and said counter rolls are aligned with a common plane including a part of said cross-sectional profile of said plate.

14. The rolling mill machine according to claim 13, further including support means between at least some of said shaping and said drive stations for support of said plate at said common plane.

15. The rolling mill machine according to claim 10, wherein said shafts of said forming rolls which are centrally located extend in said transverse direction.

16. The rolling mill machine according to claim 1, wherein said forming rolls ar non-driven.

17. A rolling mill machine having a longitudinal axis extending from an input end to an output end of said machine, said machine being for bending of plate along the longitudinal axis of the plate as the plate is moved along a path which is generally parallel to the longitudinal axis of the plate through and also generally parallel to the longitudinal axis of the rolling mill machine to provide a cross-sectional profile comprising:

means for advancing said plate along said path through said machine;

a plurality of shaping stations disposed in spaced relationship along said path;

each of said shaping stations relative to said longitudinal direction having forming rolls positioned adjacent said path;

each of said shaping stations including an upper row of a plurality of forming rolls and a lower row of a plurality of forming rolls disposed in spaced relationship with said upper row and said lower row defining a generally first transverse direction which is substantially transverse to said path of said plate and said longitudinal axis of said machine for respectively bending said plate being advanced therebetween to form said profile;

each of said forming rolls of said upper rows and said lower rows respectively combining with correspondingly disposed said forming rolls of the other of said upper rows and said lower rows to form one of a plurality of generally converging longitudinal rows of said forming rolls; each of said longitudinal rows disposed generally from said input end to said output end;

at least one said shaping station having a dimension defined by a measured distance between the outer rolls of the upper or lower rows, in said first transverse direction which is shorter than the dimension in said first transverse direction of at least one other said shaping station; and at least some of said forming rolls in said longitudinal rows each being mounted on a shaft for rotation about its corresponding shaft which said corresponding shaft extends along a second transverse direction of a set of second transverse directions; and each of said second transverse directions of said set being nonparallel with and angularly displaced with respect to said first transverse direction.

18. The rolling mill machine according to claim 17, wherein said means for advancing said plate includes a plurality of drive stations extending in said a transverse direction and each drive stations is respectively disposed adjacent a different one of said shaping stations.

19. The rolling mill machine according to claim 18, wherein said drive station includes a drive roll on one side of said plate and a plurality of free-rolling counter rolls on the other side of said plate for advancing said plate therebetween, each of said counter rolls are disposed within one of said longitudinal rows, and at least some of said free-rolling counter rolls being adjustable for alignment with said longitudinal row.

20. The rolling mill machine according to claim 17, wherein said forming rolls ar non-driven.

* * * * *

UNITED STATES PATENT AND TRADEMARK OFFICE

CERTIFICATE OF CORRECTION

PATENT NO. : 4,899,568

DATED : February 13, 1990

INVENTOR(S) : Lars Ingvar INGVARSSON

It is certified that error appears in the above-identified patent and that said Letters Patent is hereby corrected as shown below:

In column 5, line 31, delete "90°α", and insert --90°-α--.

Signed and Sealed this

Nineteenth Day of February, 1991

*Attest:*

HARRY F. MANBECK, JR.

*Attesting Officer*

*Commissioner of Patents and Trademarks*